United States Patent [19]

Stangel et al.

[11] Patent Number: 5,028,933

[45] Date of Patent: Jul. 2, 1991

[54] RADIAL WAVEGUIDE CHANNEL ELECTRONIC SCAN ANTENNA

[75] Inventors: John J. Stangel, Mahopac; Richard J. Katz, Oceanside, both of N.Y.

[73] Assignee: Unisys Corporation, Blue Bell, Pa.

[21] Appl. No.: 170,521

[22] Filed: Mar. 21, 1988

[51] Int. Cl.[5] ..... H01Q 13/10

[52] U.S. Cl. ..... 343/771

[58] Field of Search ..... 343/771, 754, 771, 785

[56] References Cited

U.S. PATENT DOCUMENTS

| | | | |
|---|---|---|---|
| 2,477,510 | 7/1949 | Chu | 343/771 |
| 2,639,383 | 5/1953 | Gruenberg | 343/771 |
| 2,648,839 | 8/1953 | Ford et al. | 343/771 |
| 2,659,005 | 11/1953 | Gruenberg | 343/771 |
| 2,761,137 | 8/1956 | Atta et al. | 343/771 |
| 2,937,373 | 5/1960 | Carter | 343/711 |
| 3,005,984 | 10/1961 | Winter et al. | 343/771 |
| 3,303,505 | 2/1967 | Bacon et al. | 343/771 |
| 4,841,308 | 6/1989 | Terakawa et al. | 343/771 |

*Primary Examiner*—William L. Sikes
*Assistant Examiner*—Robert E. Wise
*Attorney, Agent, or Firm*—Seymour Levine; Mark T. Starr

[57] ABSTRACT

A limited scan antenna wherein radiating element and phase requirements are reduced by positioning the radiating elements to radiate through a radial waveguide. The longer wavelength in the radial waveguide relative to the free space wavelength permits a wider actual separation, while maintaining grating lobe suppression. Wave refraction at the interface of the radial waveguide with free space is a function of the guide wavelength and determines the maximum scanning capability of the antenna.

4 Claims, 1 Drawing Sheet

RADIAL WAVEGUIDE CHANNEL ELECTRONIC SCAN ANTENNA

BACKGROUND OF THE INVENTION

1. Field of the Invention

The invention relates to antenna systems and more particularly to electronic scanning systems for scanning a given sector with a minimum number of radiating elements.

2. Description of the Prior Art

Beam scanning in electronically scanned antennas is achieved by controlling the excitation phase at the array elements to establish phase gradients across the array which determine the beam positions. In these systems the maximum scan angle that may be achieved without establishing grating lobes (additional principle lobes) in real space is determined by the interelement spacing in the array. A uniformly spaced array of isotropic elements may have a maximum scan angle of 90° on either side of the perpendicular to the array surface when the spacing in the scanning plane is less than ½ wavelength. This scanning range is decreased, however, to a maximum of approximately 20° on either side of the perpendicular when the spacing is increased to ¾ of a wavelength. Because of this spacing limitation conventionally designed high gain electronically scanned antennas require a significant number of radiating elements with associated control and phase shift of components.

Early efforts for reducing the significant cost of electonic scanned arrays utilized small electronically steerable arrays located in the focal region of a microwave optical system. These systems, however, exhibited low aperature efficiency, because only a portion of the aperture was illuminated for each scan angle.

Significant improvements in aperature efficiency and antenna component reductions were realized with the development of the overlapping subarray technique. This technique uses appropriate combinations of orthogonal beamformers and switching networks to achieve the desired scanning capability and beam characteristics. In these designs the primary collimating device is a lens or reflector with subarraying networks, such as, Butler matrices or Rotman lenses having apertures located in the focal regions. These antennas exhibit the unfavorable characteristics of a physically deep configuration which is concomitant with optically fed array systems. This physical depth may be reduced by substituting a Butler matrix for the primary collimating lense. This is not an attractive approach for large aperature antennas because of the complexity of the Butler matrix.

Another approach uses partially overlapped or interlaced subarrays. These, however, exhibit poor side lobe performance with reduced scanning capabilities relative to the fully overlapped subarrays.

Many of the shortcomings of the above prior art system are overcome by the invention disclosed in U.S. Pat. No. 4,507,662 assigned to the assignee of the present invention. In this device radiating elements of an antenna array are correspondingly coupled to a second array having element spacing substantially smaller than that between the radiating elements. This second array is space coupled, through a space coupling region, to a third array, which is scannable in the space coupling region. The third array has fewer elements than the second array and is approximately of the same physical size and length. Each scan angle of operation of the third array establishes a phase distribution across the second array, which is coupled to radiating array, thereby providing radiation in free space, at a scan angle corresponding to the scan angle of the third array. Since the feed has fewer elements than the radiating array, an element and associated component savings are realized. The element saving, however, is somewhat offset by the additional elements utilized in the space coupling region.

SUMMARY OF THE INVENTION

An electronically scanned antenna in accordance with the present invention includes a trough having a metallic reflecting base and sidewalls. A linear antenna array is formed in the base by providing apertures therein with predetermined spacings therebetween. These apertures are arranged to provide polarization vectors parallel to the reflecting sidewall of the trough thereby establishing radial wave transmission in the trough region. Spacing between the apertures is selected to permit scanning over a desired range within the radial propagating region, without generating grating lobes as determined by the wavelength in the radial waveguide which is longer than the free space wavelength.

Phase velocity within the trough region is less than that of free space and consequently has a refractive index greater than unity. This arrangement permits wavelength spacing of the array elements (base apertures) which are greater than that permitted for establishing a angular scan range without permitting grating lobes to appear in real space, thereby, providing a significant savings in the number of array elements and associated components.

The linear arrays may be used individually or arranged side-by-side to form a planar array. In the latter case, the arrays may have to be spaced as close as one-half wavelength in free space to avoid grating lobes in the plane perpendicular to the linear arrays. This may require that the trough be filled with a dielectric to permit propagation.

DESCRIPTION OF THE PREFERRED EMBODIMENTS

Figure 1:
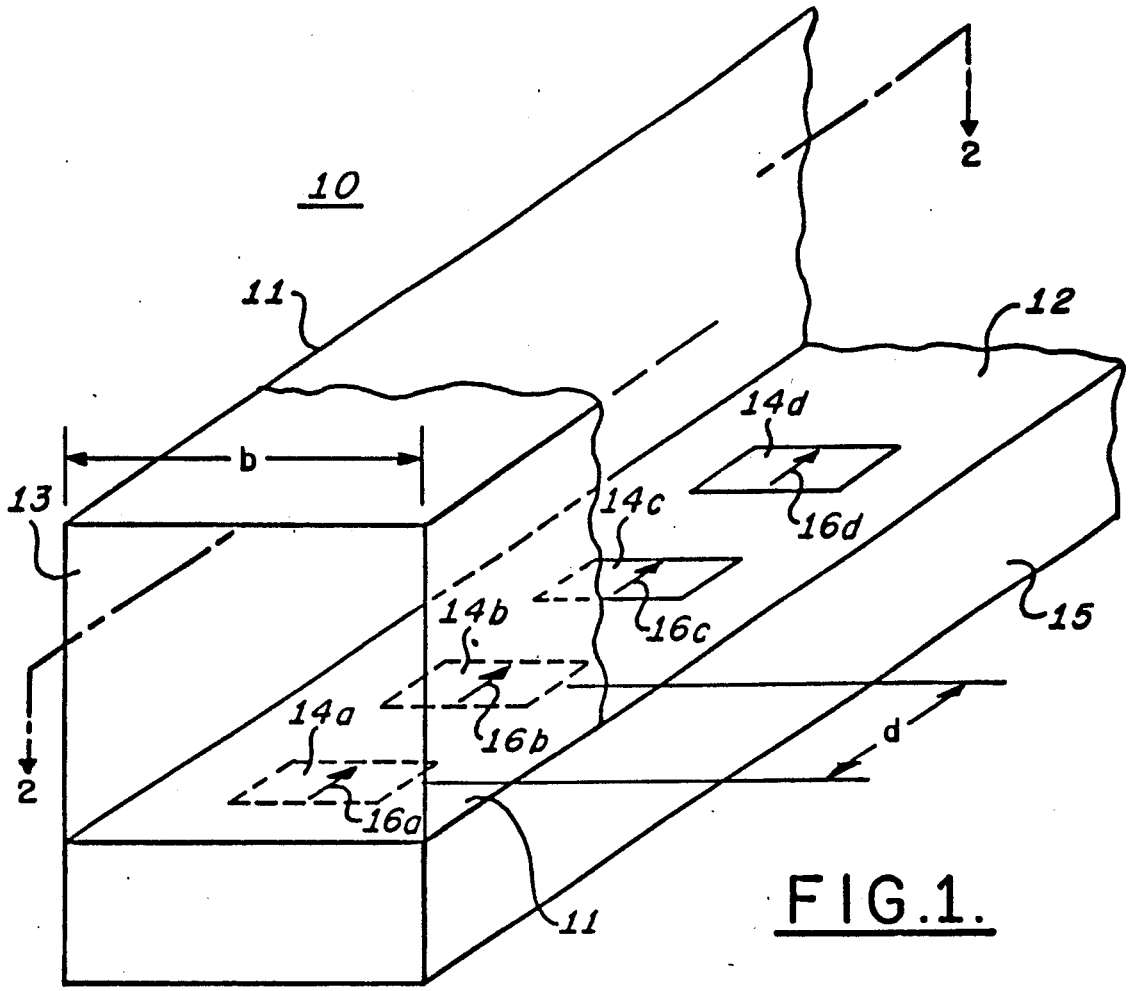
FIG. 1 is a pictorial representation of a preferred embodiment of the invention.

As shown in FIG. 1 an array antenna 10 utilizing radial wave transmission, includes a trough, having reflecting sidewalls 11, a reflecting base 12, and a dielectric material 13 filling the entire trough region. Radiating elements, as for example apertures 14*a* through 14*d* formed in the base 12 of the trough are positioned at the base of the trough to transmit or receive radiation energy through the dielectric material 13. The apertures 14*a* through 14*d* may be open ends of waveguides contained in the transmit-receive and beam control module 15. The apertures 14*a* through 14*d* of these waveguides are positioned in the base 12 such that the polarization vectors 16*a* through 16*d* are parallel to the reflecting sidewalls 11 of the trough. This configuration creates a radial wave propagation from each of the apertures with the center of each aperture being at the center of the radial wave.

Figure 2:
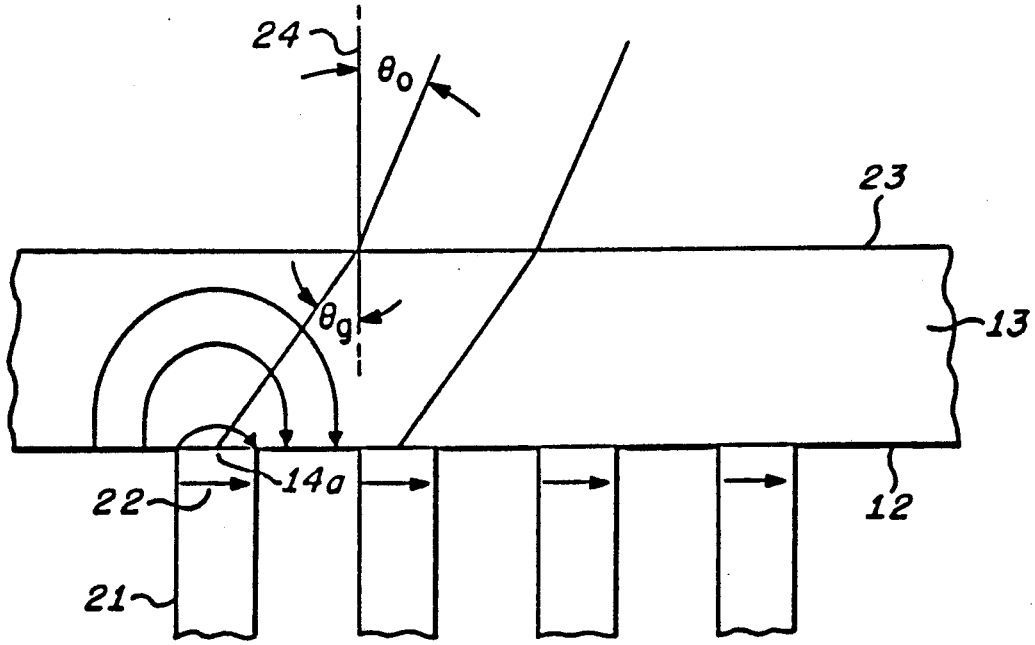
FIG. 2 is a cross-sectional view of FIG. 1 useful in explaining the operation of the invention.

In FIG. 2 is shown a waveguide 21 positioned so that its open end is the aperature 14a in the base 12 of the trough. An excitation in this waveguide will have the polarization 22, which due to the metallic base 12 and positioning of the sidewalls of the trough parallel to the polarization vector, emerges from the waveguide to provide substantially circular electric field lines about the aperture center. Thus, a $H_{01}$ radial mode is established within the trough region which propagates to the interface 23 between the dielectric 13 and free space. The radiation wavelength of this $H_{01}$ mode is a function of the dielectric filling the trough and the distance between the sidewalls 11. This wavelength $\lambda_g$ may be determined from the following equation:

$$\lambda_g = \frac{\lambda_o}{\sqrt{\epsilon - (\lambda_o/2b)^2}}$$

where $\lambda_o$ is the free space wavelength.

Since the wavelength of the radial propagation region differs from that of free space the phase velocity between the sidewalls 11 also differs. Consequently, a ray path of a wave emitted from the aperture 14a making an angle $\theta_g$ with perpendicular 24 to the interface 23 is refracted at the interface 23 to form an angle $\theta_o$ with the perpendicular 24. A relationship between these angles is established by the application of Snells Law and may be expressed as:

$$\text{Sin } \theta_o = \frac{\lambda_o}{\lambda_g} \text{ Sin } \theta_g = \frac{1}{n} \text{ Sin } \theta_g$$

where $n=\lambda_g\lambda_o$ is defined as the refractive index of the radial wave propagation region between the sidewalls 11 of the trough section.

If the spacing d between the apertures 14a through 14d is ½ a wavelength of the radial wave as indicated in FIG. 1 between apertures 14a and 14b, a beam may be scanned within the radial propagation region to a maximum scan angle of 90° without the formation of a grating lobe. Under these conditions, the maximum scan angle $\theta_{OM}$ that may be achieved in free space is given by:

$$\text{Sin } \theta_{OM} = \frac{1}{n} = \sqrt{\epsilon - (\lambda_o/2b)^2}$$

where the reactive index index n is greater than 1. This maximum scan angle is achieved with a free space wavelength spacing $d_O$ equal to the refractive index n times the wavelength spacing within the radial waveguide $d_g(d_O=nd_g)$. To achieve the same maximum scan angle with an array in free space without the appearance of the grating lobe in real space requires a maximum spacing $d'_O$ given by:

$$d_o' = \frac{n}{n+1}$$

which was derived from the well known equation for maximum spacing between elements of an array to prevent the appearance of the grating lobe in real space.

$$d_o' = \frac{1}{1 + \text{Sin } \theta_{OM}}$$

Consequently, the ratio of the number of elements M required in a conventional phased array to the number of elements N utilized in the novel radial wave antenna for equal length linear arrays and ½ wavelength radial wave spacing, to achieve equal scan sectors is:

$$\frac{M}{N} = \frac{n+1}{2}$$

For a maximum free space scan angle of 30° this ratio is equal to 1.5 indicating a 33% savings in a number of elements and associated components for the radial wave antenna relative to an array in free space.

It should be recognized as the maximum scan angle is increased this ratio decreases becoming unity, providing no advantage, for the maximum scan angles of 90°. For scan angles less than 45°, however, significant savings in number of array elements and corresponding components may be realized.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. An antenna comprising:

means having a base, an interface with free space, and reflecting sidewalls extending along a first axis that is parallel to said base, said side walls positioned with a predetermined separation therebetween and extending along a second axis, that is perpendicular to said base, from said base to said interface for guiding waves, propagating between said reflecting sidewalls, from said base to said interface;

a dielectric material having a relative dielectric constant greater than unity filling all space bounded by said base, said interface, and said reflecting sidewalls; and means positioned in said base between said reflecting sidewalls for exciting said dielectric material with waves having polarization vectors parallel to said reflecting sidewalls and said first axis and for receiving waves with said polarization vector incident to said interface.

2. An antenna in accordance with claim 1 wherein said exciting and receiving means are rectangular apertures in said base positioned to be spaced ½ a wavelength of a radial wave capable of propagating between said sidewalls.

3. An antenna in accordance with claim 2 wherein said rectangular apertures are open ends of rectangular waveguides coupled to said base.

4. An antenna comprising:

means for guiding waves having a base, an interface with free space, and reflecting sidewalls extending along a first axis and positioned with a predetermined separation therebetween, said first axis being parallel to said base and said reflecting walls extending along a second axis from said base to said interface, said second axis perpendicular to said base, said waves propagating between said reflecting sidewalls from said base to said interface;

a dielectric material having a relative dielectric constant equal to or greater than unity filling all space bounded by said base, said interface, and said reflecting sidewalls; and rectangular waveguides having open ends positioned in said base between said reflecting sidewalls for exciting said dielectric material with waves having polarization vectors parallel to said reflecting sidewalls and said first axis and for receiving waves with said polarization vector incident to said interface.

* * * * *